US006680083B2

(12) United States Patent
Ray et al.

(10) Patent No.: US 6,680,083 B2
(45) Date of Patent: Jan. 20, 2004

(54) CEILING DESIGN TOOL AND METHOD

(76) Inventors: Robert M. Ray, 9517 Marilla Dr., Lakeside, CA (US) 92040-2803; Linda Seward, 9517 Marilla Dr., Lakeside, CA (US) 92040-2803

( * ) Notice: Subject to any disclaimer, the term of this patent is extended or adjusted under 35 U.S.C. 154(b) by 79 days.

(21) Appl. No.: 10/124,315

(22) Filed: Apr. 18, 2002

(65) Prior Publication Data

US 2002/0155220 A1 Oct. 24, 2002

Related U.S. Application Data

(60) Provisional application No. 60/284,586, filed on Apr. 18, 2001.

(51) Int. Cl.[7] ..... B05C 17/12; B05D 1/28; B05D 5/00

(52) U.S. Cl. ..... 427/277; 427/284; 427/355; 15/231; 15/235.4; 425/385; 425/458; D8/45

(58) Field of Search ..... 15/104.001, 210.5, 15/231, 235.4, 245.1; 425/385, 458; D8/45; 427/277, 284, 355

(56) References Cited

U.S. PATENT DOCUMENTS

| | | | | | |
|---|---|---|---|---|---|
| 830,683 | A | * | 9/1906 | Spangler | 15/235.4 |
| 1,154,453 | A | * | 9/1915 | Stratton | 15/235.4 |
| 2,190,811 | A | * | 2/1940 | Van Zeeland | 15/235.4 |
| 3,180,260 | A | | 4/1965 | Joseph | 101/401.1 |
| 3,669,069 | A | | 6/1972 | Bourboulis | 118/102 |
| 3,817,178 | A | | 6/1974 | Hagen | 101/379 |
| 4,030,414 | A | | 6/1977 | McGuire | 101/379 |
| 4,123,973 | A | | 11/1978 | Genevase | 101/379 |
| 4,201,801 | A | | 5/1980 | Hori | 427/274 |
| 4,930,179 | A | | 6/1990 | Wright et al. | 15/230.11 |
| 5,000,671 | A | | 3/1991 | Nolte | 425/231 |
| 5,401,231 | A | | 3/1995 | Hebert | 492/37 |
| 5,524,316 | A | | 6/1996 | Johnson | 15/210.5 |
| 5,580,608 | A | | 12/1996 | Capoccia | 427/277 |
| 5,695,788 | A | | 12/1997 | Woods | 425/87 |
| D419,409 | S | | 1/2000 | Stover, Jr. et al. | D8/45 |

* cited by examiner

*Primary Examiner*—Mark Spisich
(74) *Attorney, Agent, or Firm*—Richard C. Litman

(57) ABSTRACT

A ceiling design tool and method of using the tool for forming plaster designs on walls and ceilings comprising a circular planar face portion having a centered cylindrical handle. The face portion comprises a rubber layer over a burlap layer clamped onto the edge of a circular metal plate. The face portion of the tool is dipped in a fluid plaster mixture and applied to a ceiling or wall surface of either plaster or drywall in a stepwise rolling motion to create a unique textured surface such as half-moons, bead work and scroll patterns.

7 Claims, 3 Drawing Sheets

CEILING DESIGN TOOL AND METHOD

CROSS-REFERENCE TO RELATED APPLICATION

This application claims the benefit of U.S. Provisional Patent Application Serial No. 60/284,586, filed Apr. 18, 2001.

BACKGROUND OF THE INVENTION

1. Field of the Invention

The present invention relates generally to plastering tools and, more specifically, to a texturing device for forming designs in wet plaster on plastered or dry wall ceilings or walls.

2. Description of Related Art

The related art of interest describes various texturing hand tools, but none discloses the present invention. There is a need for a texturing hand tool for plasterers which is simple to use, versatile in application, and economical to produce. The related art will be discussed in the order of perceived relevance to the present invention.

U.S. Pat. No. 3,669,069 issued on Jun. 13, 1972, to Cedric D. Bourboulis describes a tool for texturizing painted surfaces comprising a plurality of tapered S-shaped resilient synthetic rubber petals or flaps which depend from a formable backing member. The petals or flaps are of unequal length. The tool has a removable handle for ease in applying it to wall and ceiling surfaces to place and pound the backing member parallel to the surface being coated to create random patterns. Therefore, no twisting, turning or other manipulation of the tool is required. The tool is distinguishable for its required tapered S-shaped resilient petals or flaps and its limitation to a singular movement of the tool.

U.S. Pat. No. 5,000,671 issued on Mar. 19, 1991, to Ray J. Nolte describes a hand-held, self-cleaning machine for imprinting sculptured designs in mortar, joint compound, clay or cement on walls and ceilings using embossed design rollers. A water jet spray and a vacuum is incorporated in the machine to continuously clean the design roll and vacuum the contaminated water. The hand machine is distinguishable for its mechanized structure and requirement for a continuous cleaning water supply.

U.S. Pat. No. 4,201,801 issued on May 6, 1980, to Kiyoshi Hori describes a method of forming a decorative relief pattern initially painted on an article or a substrate by utilizing a roller with an assortment of relief patterns on the roller. The roller is distinguishable for requiring a relief pattern to form a design in wet paint.

U.S. Des. Pat. No. 419,409 issued on Jan. 25, 2000, to Marlyn L. Stover, Jr. et al. describes a dry wall texturing tool comprising a wide curved blade attached to a pair of horizontal studs by a plurality of wing nuts with a double serrated handle attached perpendicularly to the blade between the two studs. The tool is distinguishable for its curved blade and its handle serrated on both sides.

U.S. Pat. No. 5,524,316 issued on Jun. 11, 1996, to Max Johnson describes a hand tool for decoratively applying plaster on a ceiling comprising a handle attached to a stiff but resilient blade with a serrated distal, longitudinal edge having either two spaced-apart tool alignment marks or a pivot device at one end of the blade. The tool is distinguishable for requiring an elongated serrated blade.

U.S. Pat. No. 3,180,260 issued on Apr. 27, 1965, to Bernard L. Joseph describes a stencil or printing member set and a method of assembling and using the tool. The stencil has a circular three-dimensional polyurethane foam resin pattern adhesively coated on a base consisting of a disc-shaped base of equal diameter. The base is attached to another base of smaller diameter and a terminal rod handle. The stencil coated with paint is applied to a wall perpendicularly to create one design which can differ in thickness due to the difference applied by hand pressure. The stencil tool is distinguishable for requiring a pattern cut in the stencil face.

U.S. Pat. No. 3,817,178 issued on Jun. 18, 1974, to Dean C. Hagen describes a square decorating tool which is coordinated with a chain attached to one wall. The hand tool has a square backing plate having a hook at one end for the chain and a looped handle. A base plate made of either aluminum or magnesium is attached offset to the backing plate. A polyurethane foam pattern is attached to the base plate by an adhesive. The aqueous mixture of lime hydrate and cement is applied to the tool and the ceiling patterned in steps utilizing the chain and a chalked guide line. The tool is distinguishable for its required cut foam pattern and the chain attachment.

U.S. Pat. No. 4,030,414 issued on Jun. 21, 1977, to James T. McGuire describes a one-piece wall paint decorating device comprising a thick rectangular cellulose sponge with a cutout pattern on one side and a handle cut out on the opposite side or on a side. The device is distinguishable for its one-piece cellulose sponge construction.

U.S. Pat. No. 4,123,973 issued on Nov. 7, 1978, to Frank O. Genevase describes a brocading tool for applying paste material in a design on ceilings and walls. The first embodiment uses a spiral pattern of a wire coated with a thick resilient unidentified covering on a reinforced stem on a cylindrical handle. The second embodiment utilizes a radial pattern of fingers supported by individual braces similar to an umbrella attached to a handle. The tool is distinguishable for its required spiral or finger pattern.

U.S. Pat. No. 4,930,179 issued on Jun. 5, 1990, to Paul B. Wright et al. describes a roller paint decorating tool having flexible flaps made of sheepskin or chamois leather to simulate ragging, sponging and rag-rolling effects. The tool is distinguishable for requiring a roller as a substrate for the flexible straps.

U.S. Pat. No. 5,401,231 issued on Mar. 28, 1995, to Jacques O. Hebert describes a texturing roller for applying drywall or plaster to a wall or ceiling comprising multiple leather discs riveted to the roller cylinder. The tool is distinguishable for requiring a textured roller assembly of riveted leather discs.

U.S. Pat. No. 5,580,608 issued on Dec. 3, 1996, to John S. Capoccia describes a splaying tool for imparting a knock-down pattern to a wet topping compound on a ceiling. The tool has a flexible blade held by a base member which is angled 30° to 60° from a second edge member attached to a long handle. The object of the curvature between the blade and the handle requires the handle to be parallel to the wall or ceiling being patterned. The splaying tool is distinguishable for requiring an oriented handle and a lengthy blade.

U.S. Pat. No. 5,695,788 issued on Dec. 9, 1997, to John R. Woods describes a tool for repairing small holes or cracks in damaged walls or recently installed plaster or plasterboard walls by dispensing plaster material, e.g., drywall mud material, spackle, grouting, and cementitious material, from a flat plate having either a flat triangular shape or right-angled plates (for inside or outside wall corners). The plate has a tubular orifice extension for inserting the nozzle of the plaster source. The contacting surface of the base plate has protrusions arranged in triangular fashion. The tool is distinguishable for requiring a construction adapted to receive a nozzle of a supply tube to deposit the plaster material.

None of the above inventions and patents, taken either singly or in combination, is seen to describe the instant invention as claimed.

SUMMARY OF THE INVENTION

The invention is a hand tool device for forming designs in a wet plaster layer laid on a plaster or drywall ceiling. In a preferred embodiment, the tool has a 10 inch diameter face of a vulcanized rubber sheet. The rubber sheet is backed by a burlap layer placed on a metal plate. The rubber sheet and burlap layer are secured on the metal plate by a metal band and a screw clamp. The round plate has a female threaded flange on its bottom surface which accommodates a short section of a threaded metal pipe. The pipe holds a cylindrical wooden handle. The tool is dipped in a plaster mix having a consistency of gravy and is moved in steps in a rolling action across the ceiling surface to form a unified textured design. It is contemplated that other surfaces such as walls, countertops, floors and the like can also be treated with this tool. Furthermore, coating materials other than wall plaster can be utilized with this tool such as plastic, grout, and the like. Many different designs are possible with the invention, including half-moon, bead work, etc.

Accordingly, it is a principal object of the invention to provide a hand tool for forming a plaster design coating on a plaster or dry wall ceiling.

It is another object of the invention to provide a hand tool for forming ceiling designs with wet plaster.

It is a further object of the invention to provide a hand tool having a circular face positioned on a perpendicular handle.

Still another object of the invention is to provide a hand tool having a rubber applying surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
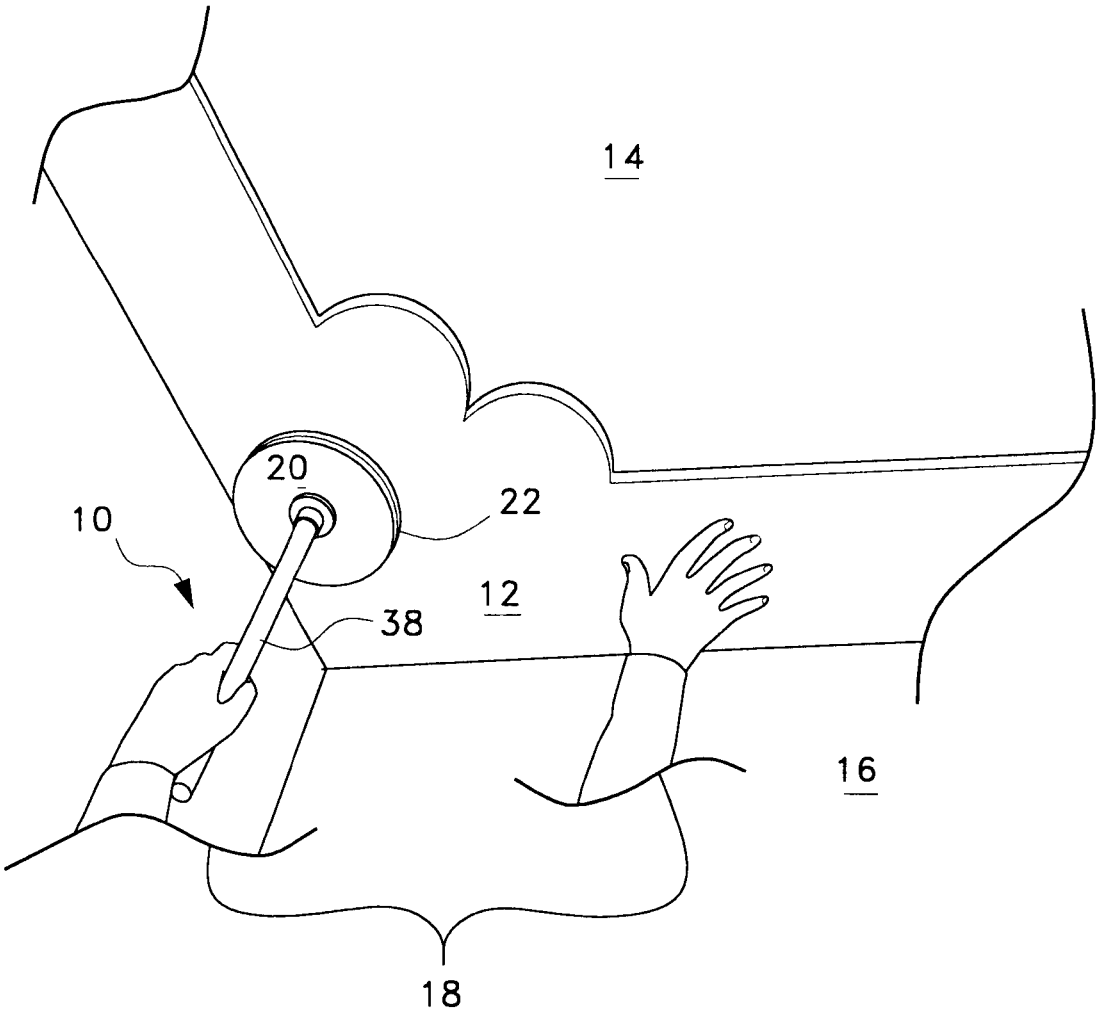
FIG. 1 is an environmental, perspective view of a ceiling design hand tool manipulated by a craftsman to form a design in a wet plaster area on the ceiling according to the present invention.

The present invention is illustrated in FIG. 1 as a ceiling or wall design hand tool 10 for forming a plaster design 12 on a ceiling 14 or a wall 16 by a craftsman 18 by pressing the tool 10 against a freshly plastered area.

Figure 2A:
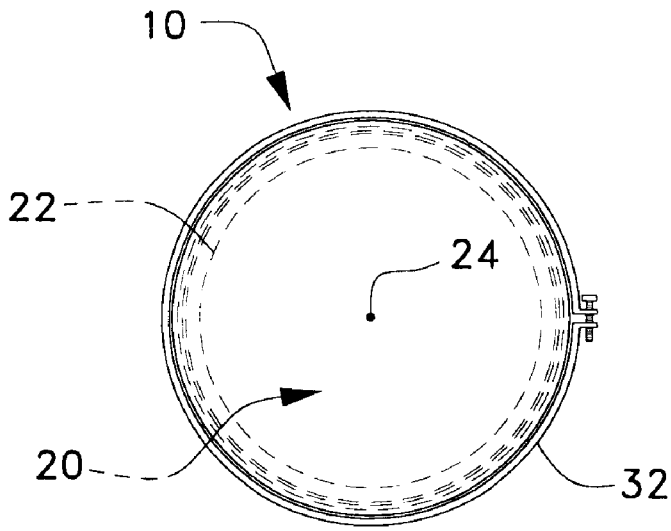
FIG. 2A is a top plan view of the ceiling design hand tool according to the present invention.
Figure 2B:
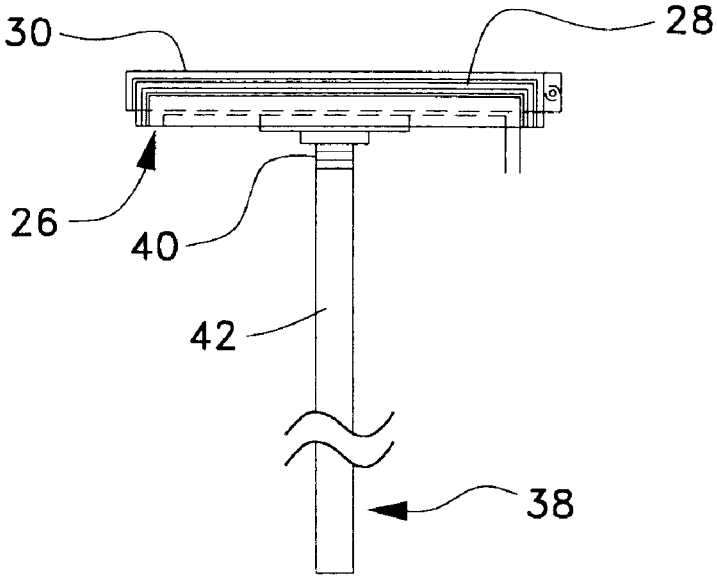
FIG. 2B is a schematic side view of the ceiling design hand tool according to the present invention.

The tool 10, as shown in FIGS. 2A and 2B, comprises a circular metal base plate 20 having a circumference 22 shown in phantom in FIG. 2A and having a diameter of about ten inches, a center 24, and a peripherally flanged and downwardly depending edge 26 having a nominal thickness of a half-inch. A circular burlap layer 28 overlaps the plate 20 and the depending edge 26. A circular rubber layer 30 overlaps the burlap layer 28. The burlap layer 28 and the rubber layer 28 are fastened to the plate 20 by a flanged metal ring 32 and a screw clamp 34 around the peripherally flanged edge 26 of the plate 20.

An internally threaded circular metal female flange 36 is attached to and centered on the bottom surface of the metal plate 20. A cylindrical handle 38 comprises a short cylindrical pipe or nipple 40 having an internal diameter 1.5 inches and a length of 1.5 inches, which is connected to a length, e.g., 16 inches, of a cylindrical wooden rod 42, 1.5 inches in diameter. The pipe 40 is connected to the metal female flange 36. The total thickness of the vulcanized rubber layer 30, the burlap layer 28, and the base plate 20 is about ¾ inch. The clamp 34 is approximately ⅜ inch wide. The female threaded flange 36 has a diameter of around 1.5 inches.

Figure 3:
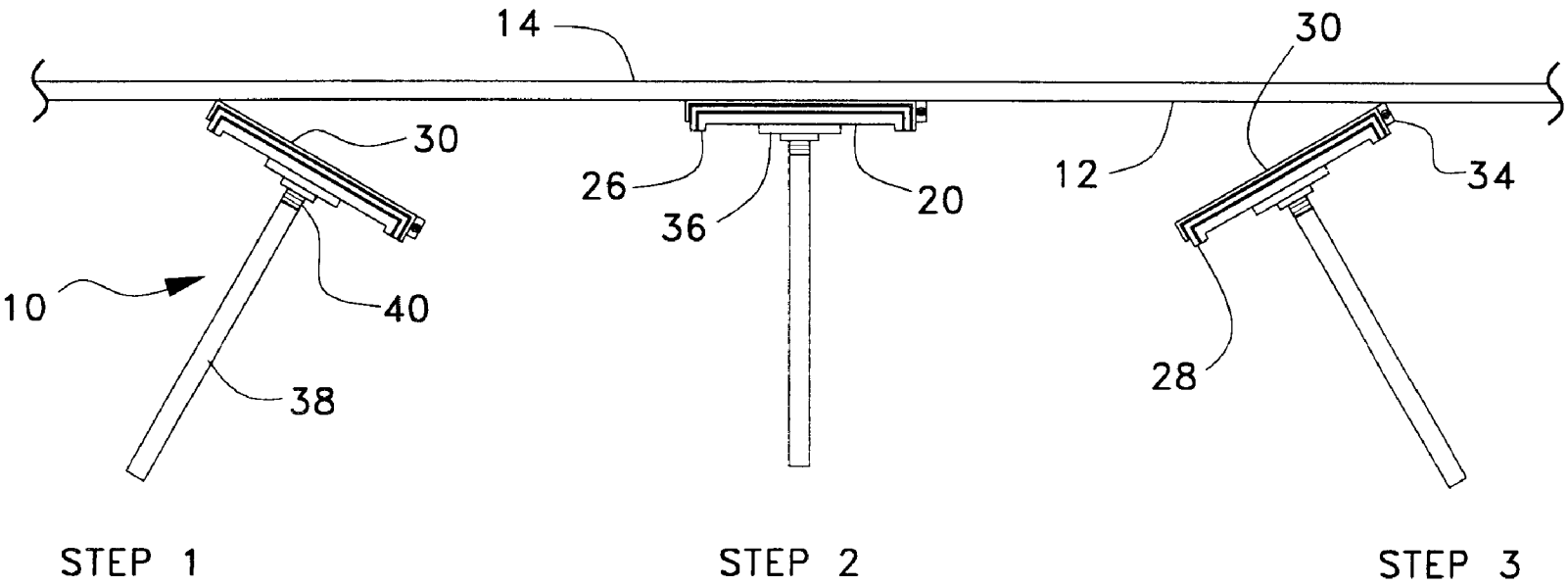
FIG. 3 is a schematic diagram of the forming steps by the hand tool.

FIG. 3 illustrates the texturing technique employing the tool 10 on the ceiling 14 in three steps labeled as steps 1, 2 and 3. Step 1 depicts the initial coating step with the rubber layer 30 of the ceiling design tool 10 dipped in a fluid plaster mixture and distributed on a ceiling surface 14, by rolling in steps 2 and 3 to create a design.

It is understood that different shapes other than the circular shape depicted are contemplated in the invention to accomplish the desired decorative effect including half-moon, bead pattern, scroll pattern, and the like.

It is to be understood that the present invention is not limited to the embodiments described above, but encompasses any and all embodiments within the scope of the following claims.

We claim:

1. A design tool for forming plaster designs on a flat surface comprising:

a circular metal plate having a specific diameter, a center and a peripheral flanged edge;

a circular rubber layer having a diameter greater than said specific diameter;

a circular burlap layer having a diameter commensurate with said specific diameter;

said rubber layer overlapping said burlap layer and said metal plate, and fastened by a metal ring and screw clamp around said peripheral flanged edge of said metal plate;

a circular metal flange attached to and centered on a bottom surface of said metal plate; and a cylindrical handle connected to said metal flange;

whereby the rubber layer of the ceiling design tool can be dipped in a fluid plaster mixture and distributed on a ceiling surface to create a design by a rolling motion.

2. The ceiling or wall design tool according to claim 1, wherein the cylindrical handle comprises a short cylindrical pipe and a length of cylindrical wooden rod connected to said metal flange.

3. The ceiling or wall design tool according to claim 2, wherein said pipe includes external threading, the tool including internal threading of said metal flange for attachment of the pipe having said external threading.

4. A method of forming a ceiling or wall design with plaster by a circular shaped tool according to claim 1 comprising:

a first step of coating a wall or ceiling with the circular shaped tool having a circular metal plate having a specific diameter, a center and a peripheral flanged edge;

a circular rubber layer having a diameter greater than said specific diameter;

a circular burlap layer having a diameter commensurate with said specific diameter;

said rubber layer overlapping said burlap layer and said metal plate, and fastened by a metal ring and screw clamp around said peripheral flanged edge of said metal plate;

a circular metal flange attached to and centered on a bottom surface of said metal plate; and a cylindrical handle connected to said metal flange;

dipping the tool in a fluid plaster mixture;

rolling the fluid plaster mixture onto the ceiling or wall by first contacting a rearmost edge of the tool to the ceiling or wall surface;

contacting the ceiling or wall surface with the entire plaster containing surface of the tool;

lifting the rearmost edge of the tool from the ceiling or wall surface; and repeating the rolling step with a fresh load of fluid plaster mixture;

whereby a uniform pattern can be formed on the ceiling or wall.

5. The method according to claim 4, wherein a half-moon pattern is created.

6. The method according to claim 4, wherein a bead work pattern is created.

7. The method according to claim 4, wherein a scroll pattern is created.

* * * * *